US009842487B2

(12) United States Patent
Williams

(10) Patent No.: US 9,842,487 B2
(45) Date of Patent: Dec. 12, 2017

(54) SMOKE DETECTOR TEST DEVICE

(71) Applicant: Ralph Lee Williams, San Jose, CA (US)

(72) Inventor: Ralph Lee Williams, San Jose, CA (US)

( * ) Notice: Subject to any disclaimer, the term of this patent is extended or adjusted under 35 U.S.C. 154(b) by 0 days.

(21) Appl. No.: 14/913,271

(22) PCT Filed: Aug. 19, 2014

(86) PCT No.: PCT/US2014/051612
§ 371 (c)(1),
(2) Date: Feb. 19, 2016

(87) PCT Pub. No.: WO2015/026773
PCT Pub. Date: Feb. 26, 2015

(65) Prior Publication Data

US 2016/0203704 A1 Jul. 14, 2016

Related U.S. Application Data

(60) Provisional application No. 61/868,080, filed on Aug. 20, 2013.

(51) Int. Cl.
*G08B 29/00* (2006.01)
*G08B 29/14* (2006.01)

(52) U.S. Cl.
CPC ..... *G08B 29/145* (2013.01)

(58) Field of Classification Search
CPC combination set(s) only.
See application file for complete search history.

(56) References Cited

U.S. PATENT DOCUMENTS

| | | | | |
|---|---|---|---|---|
| 8,205,478 | B1 * | 6/2012 | Hallisey | G08B 29/145 340/515 |
| 2007/0186618 | A1 | 8/2007 | Ackerman | |
| 2013/0026400 | A1 * | 1/2013 | Allen, Jr. | A01M 7/0046 251/129.01 |
| 2014/0252027 | A1 * | 9/2014 | Lord | G08B 21/02 222/79 |

OTHER PUBLICATIONS

International Search Report and Written Opinion for Application No. PCT/US2014/051612, dated Oct. 29, 2014 (8 pages).

* cited by examiner

*Primary Examiner* — Travis Hunnings
(74) *Attorney, Agent, or Firm* — Squire Patton Boggs (US) LLP

(57) ABSTRACT

A device for testing smoke detectors comprises a barrel, an end-piece coupled to one end of the barrel and which is capable of covering at least a sensing area of a smoke detector, and a device body coupled to the opposite end of the barrel and which is capable of carrying a pressurized dispensing container having a smoke-simulating substance.

18 Claims, 1 Drawing Sheet

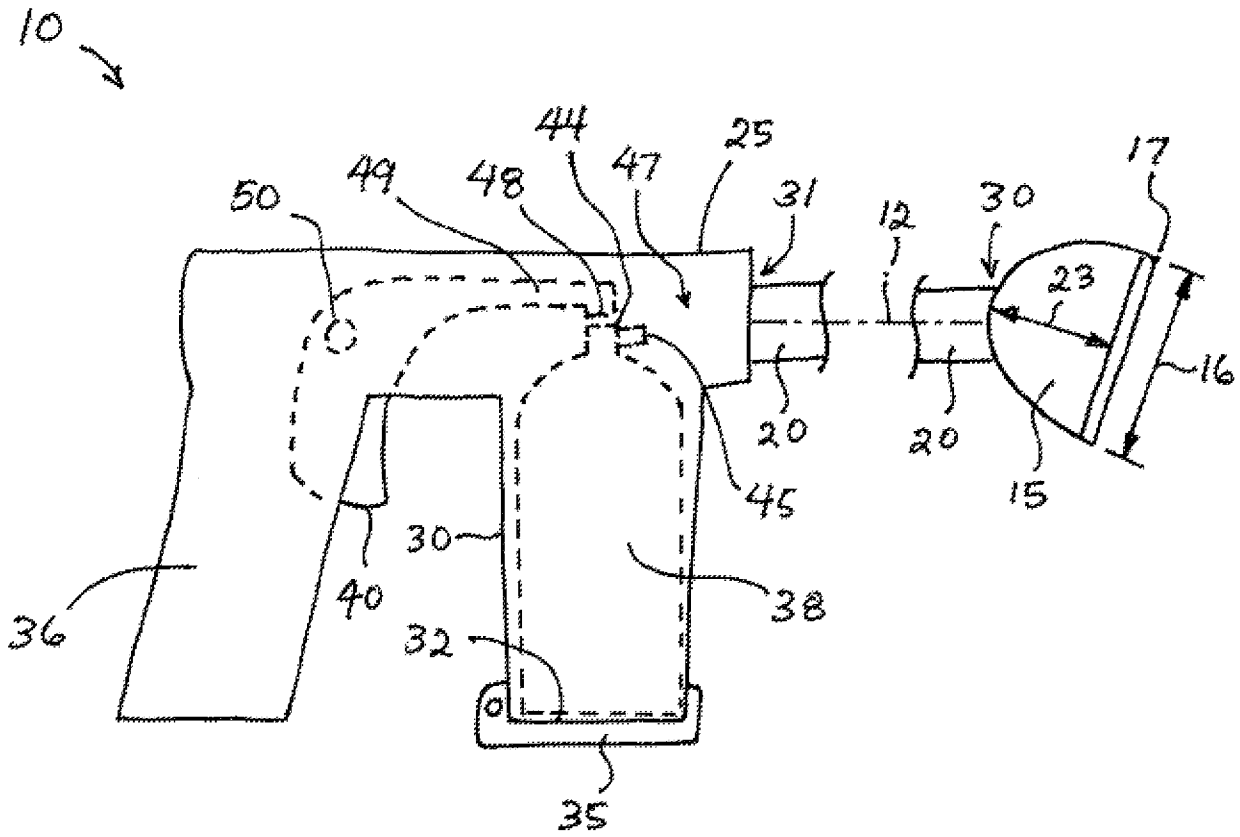
10
17
16
23
15
30
20
12
31
20
25
45
38
47
44
48
49
50
35
30
32
40
36

SMOKE DETECTOR TEST DEVICE

RELATED APPLICATIONS

This invention claims the benefit of U.S. Provisional Patent Application Ser. No. 61/868,080, filed on 20 Aug. 2013, which provisional application is incorporated as if fully, including any drawings, set forth herein.

FIELD

This invention relates to devices for testing of smoke detectors in situ, particularly when the smoke detectors are in remote, hard to reach locations.

BACKGROUND

Smoke detectors are an integral part of the overall safety features of home, commercial establishments and industrial facilities. As is well-known, smoke detectors sense smoke in the air as an indicator of fire. Most smoke detectors sense smoke optically when smoke interferes with the transmission of light from a source to a detector or ionization, rather a change in ionization, recognition. Regardless of the operating mechanism of smoke detectors, they must, and in the case of commercial and industrial use, are generally required by codified fire prevention regulations to be tested at intervals that may range from monthly to yearly to determine if they are still operating at an acceptable level of detection.

With regard to home installations, smoke detectors are most often installed in walls, preferable on the ceilings of each room of a domicile where they are generally visible and readily available for testing.

Commercial and industrial settings can present a quite different scenario. Commercial establishments often include overhead duct work through which heating and air conditioning of the building is carried out. This ductwork may comprise a mechanism to shut down hot or cold air flow in the event of a fire to help prevent spread of the fire and more importantly the smoke, which is often a more serious concern than the fire itself insofar as human life is concerned. To assist in the recognition of a hazardous situation, the ductwork often contains smoke detectors that may be located on any surface of the ductwork at any location. Access to the interior of the ductwork is, however, usually limited to hatches located at intervals along the ductwork. If a smoke detector is not positioned near enough to a hatch, it can be very difficult to reach the detector to test it. Further, the intensity of the air flow through the ducts can seriously hinder remote testing.

The situation is similar, in fact usually exacerbated, in industrial settings, in particular those settings in which a great deal of electrical energy is being used such as in so-called server farms. Server farms are simply a collection of computers used to perform tasks that far exceed the capabilities individual computers. Well-known examples are super computer arrays. These arrays use tremendous amounts of electrical energy and generate concomitantly enormous amounts of heat. To keep the cables supplying the power cool, the cables are often run under false floors in which huge quantities of cooling air is constantly circulated. Under such drastic conditions, fire is always a concern and the false floors are generally fitted with smoke detectors to warn of impending danger. As with the overhead ductwork, the false floors are fitted with hatches at various locations, which may or may not provide ready access to smoke detectors for testing purposes.

Current procedures for testing smoke detectors involves mostly simply reaching out to the smoke detector simply by hand or by means of a long stick that has the detecting unit attached one end of it. These devices cannot reach, and are not adaptable to do so, smoke detectors locate in remote, often tight in terms of space, locations.

What is needed, then, is a device for quickly and accurately testing smoke detectors located in remote or tight or both remote and tight locations that simply cannot readily, if at all, be reached by current implements and procedures. The instant invention is directed to such a device.

SUMMARY

Thus, one aspect of the instant invention is a device for testing smoke detectors in remote locations, the device comprising:

- a barrel having a proximal end and a distal end;
- an end-piece fluidly coupled to the distal end of the barrel, the end-piece capable of fully encompassing the sensing unit of an installed smoke detector or the entire exposed surface of the smoke detector; and
- a device body coupled to the proximal end of the barrel, the device body comprising:
  - a hollow chamber fluidly coupled to the barrel,
  - a canister configured to carry a pressurized dispensing container such that a nozzle of the pressurized dispensing container is fluidly coupled to the hollow chamber,
  - a handle, and
  - a trigger coupled to the handle and configured to depress an actuator button of the pressurized dispensing container to release a smoke-simulating substance from the nozzle of pressurized dispensing container to the end-piece.

In an aspect of this invention, the canister includes a canister proximal end, a canister distal end, and a cap movably coupled to the canister distal end. The canister proximal end is fluidly coupled to the hollow chamber of the device body, and the cap is configured to sealably enclose the pressurized dispensing container within the canister.

In an aspect of this invention, the end-piece is cup-shaped.

In an aspect of this invention, the barrel is a rigid, curved construct having a fixed length of about 12 inches to about 48 inches.

In an aspect of this invention, the barrel is a flexible construct having a fixed length from about 12 inches to about 48 inches.

In an aspect of this invention, the barrel is an extendable, retractable member having a retracted length of about 12 inches and an extended length of about 48 inches.

In an aspect of this invention, the end-piece is removably coupled to the distal end of the barrel.

In an aspect of this invention, the cup-shaped end-piece comprises a cup and a gasket disposed around a rim of the cup.

In an aspect of this invention, the cap is moveably coupled to the canister by a hinge.

In an aspect of this invention, a gasket is disposed between a lip of the cap and an edge of the canister distal end.

In an aspect of this invention, the handle comprises a pistol grip.

In an aspect of this invention, the barrel is fixedly coupled to the device body.

In an aspect of this invention, the barrel is removably coupled to the device body.

In an aspect of this invention, the canister is fixedly coupled to the device body.

In an aspect of this invention, the canister is removably coupled to the device body.

An aspect of this invention is a kit comprising:

a device body of this invention;

two or more barrels of this invention wherein the barrels are of varying lengths, curvatures, or both lengths and curvatures;

two or more end-pieces of this invention; and one or more pressurized cans of commercial smoke-simulating substance.

DETAILED DESCRIPTION OF THE INVENTION

Brief Description of the Figures

The FIGURES are provided for illustrative purposes only to assist in understanding the invention herein and are not intended nor should they be construed as limiting the scope of this invention in any manner.

FIG. 1 is a schematic representation of a smoke detector tester of this invention.

DISCUSSION

It is understood that, with regard to this description and the appended claims, any reference to any aspect of this invention made in the singular includes the plural and vice versa unless it is expressly stated or unambiguously clear from the context that such is not intended.

As used herein, any term of approximation such as, without limitation, near, about, approximately, substantially, essentially and the like, means that the word or phrase modified by the term of approximation need not be exactly that which is written but may vary from that written description to some extent. The extent to which the description may vary will depend on how great a change can be instituted and have one of ordinary skill in the art recognize the modified version as still having the properties, characteristics and capabilities of the word or phrase unmodified by the term of approximation. In general, but with the preceding discussion in mind, a numerical value herein that is modified by a word of approximation may vary from the stated value by ±10%, unless expressly stated otherwise.

As used herein a "seal" refers to a device that helps to form a relatively tight interface between two contiguous surfaces in order to minimize leakage of a smoke-simulating aerosol during testing of a smoke detector using a device of this invention. By "relatively tight interface" is meant that the contiguous surfaces need not necessary form a fully gas-tight interface but the interface should prevent escape of the aerosol for a sufficient period of time for the smoke detector to react to the aerosol if the smoke detector is in working order. The interface will comprise the lip or edge of an end piece of this invention, as described below, and the surface of the smoke detector around the smoke sensor region or the surface to which the smoke detector is mounted if the end piece encompasses the entire body of the smoke detector. For the purposes of this invention, a seal can comprise, without limitation, an O-ring seal, a cup seal or a face seal.

The terms "proximal" and "distal" simply refer to the opposite ends of a construct and are used as a method of orienting an object with relation to another object such as the orientation of the end of a canister herein in relation to a hollow tube to which it is coupled. In general, which end is designated as proximal and which as distal is purely arbitrary unless the context unambiguously expresses otherwise.

As used herein, the use of "preferred," "presently preferred," "preferably," or "more preferred," and the like refers to preferences as they exist at the time of filing of this application.

As used herein, "fluidly coupled" means that a smoke-simulating aerosol can pass substantially unimpeded between components of a test device of this invention when the components are permanently or reversibly coupled together and the tester is in use.

As used herein, a "barrel" refers to a hollow tube as exemplified by, without limitation, a plumbing pipe, electrical conduit, laboratory tubing and the like. For the purpose of this invention, a barrel may be circular in cross-section, that is it may be cylindrical, or it may be oval in cross-section or it may have a cross-sectional shape of any other desired configuration.

FIG. 1 illustrates a smoke detector test device of this invention. Each of the elements of the test device shown may be made of the same material or of different materials. The materials can be, without limitation, metals, alloys, polymers or composites. It is presently preferred, however, to fabricate all elements of the test device from the same material, preferably at present a polymer, which polymer can be, without limitation, PVC (polyvinyl chloride), CPVC (chlorinated polyvinyl chloride) or PEX (high density polyethylene). A consideration to be made when selecting a barrel polymer is that, when smoke-detector engaging end piece 15 is placed over a smoke detector and pressure is applied at the handle end of the device, the barrel will be rigid enough to relay that pressure to the end piece and hold it firmly in place during testing. This can be achieved by the selection of the polymer itself or by adjusting the thickness of the wall of the polymer barrel or both.

Smoke detector engaging end-piece 15 is presently preferred to be cup-shaped as shown in FIG. 1. The cup will have a diameter 16 that permits it to be placed over at least the sensing portion, preferably at present then entire exposed body, of a smoke detector (not shown). Optional gasket 17 will form a seal either with the body of the smoke detector or with surface to which the smoke detector is attached to assure that the sensing element of the smoke detector is exposed to the smoke-simulating aerosol for a sufficient period of time to properly determine the status of the smoke detector using smoke detector test device 10. While a cup-shape as shown in FIG. 1 is presently preferred, it is understood that end piece 15 may have any shape so long as it completely covers at least the sensing element of the smoke detector, preferably at present, the entire body of the smoke detector. A presently preferred diameter 16 for end piece 15 is approximately 6 inches since this will permit testing of the majority of commercial smoke detectors in use at the time of filing of this application. End-piece 15 can be of any depth 23 that will permit proper coverage of a smoke detector. It is presently preferred that the depth be approximately 3 inches since, as above, this will accommodate the vast majority of commercial smoke detectors in use at the time of the filing of this application. If barrel 20, discussed below, is straight, the angle that centerline 23 of end-piece 15 makes with centerline 12 of the straight barrel can be modified to improve application of the end piece to a smoke detector. With a straight barrel, an angle of about 30° to about 45° is presently preferred. If barrel 20 is curved, which is the presently preferred configuration, the angle of end-piece 15 to the distal end of barrel 20 may be any angle that provides good coverage of a smoke detector. In fact, it is an embodiment of this invention that the coupling of end-piece 15 to barrel 20 may comprise a ball-joint such that the angle of end-piece 15 can be continuously changed to any desired configuration.

End-piece 15 is coupled to distal end 30 of barrel 20 of device 10. The coupling may be permanent, that is, end piece 15 and barrel 20 may be one piece either glued together or initially formed as one construct. It is presently preferred, however, that end-piece 15 be coupled to barrel 20 by a reversible coupling such as, without limitation, a threaded coupling, a compression fitting or a Swagelok®. This will allow changing out end-piece 15 to accommodate various size and shape smoke detectors. Barrel 20 can be any length from about 12 inches to about 48 inches. As mentioned previously, a presently preferred configuration for barrel 20 is a curve that describes an arc with a degree of bending of about 20° to about 40°. Barrel 20 can be rigid or it can be fabricated of a flexible material such as, without limitation, electrical conduit. If electrical conduit is used, a tube having an outside diameter smaller that the inside diameter of the conduit may be run through the conduit and may be fluidly coupled to the end piece and to the hollow chamber so as to minimize escape of the smoke-simulating aerosol from the conduit. While any diameter barrel may be used, it is presently preferred that it be relatively small to assure unimpeded insertion of the device into close spaces. It is presently preferred that the barrel have an inside diameter of about ¼ inch to about ¾ inch. The outside diameter will vary according to the thickness of the wall of the barrel and this thickness will depend on the nature of the material of which the barrel is fabricated so as to achieve a rigid barrel or a flexible barrel with sufficient rigidity to allow sufficient pressure to be transmitted to the end piece when it is placed over a smoke detector.

The above proviso pertains to conduit used to fabricate a flexible barrel: the conduit must be stiff enough to hold the shape into which it has been bent sufficiently to permit pressure applied at the handle end of device 10 to be transmitted to the end-piece and hold it in place over a smoke detector. In another embodiment, barrel 20 may comprise a telescoping construct that allows adjustment of the length of the barrel to fit various space requirements in the vicinity of a smoke detector being tested. A telescoping barrel may be able to span the entire range of barrel lengths discussed above or it may be fabricated to extend to a lesser or greater distance than a single length rigid barrel.

At the other end, i.e., proximal end 31 of barrel 20, barrel 20 is coupled to device body 25. Again, the coupling of barrel 20 to device body 25 may be permanent or reversible. As above, a reversible coupling is preferred such that the length and curvature of barrel 20 may be changed by replacing one barrel with another. It is, in fact, an aspect of this invention that device 10 can be provided as a kit that includes different length barrels, different curvature barrels, different diameter cup-shaped constructs and any combination of these.

Device body 25 comprises canister 30. Canister 30 is coupled to device body either permanently or, as above, in a reversible manner to accommodate different size and shape aerosol generators 38. At distal end 32 of canister 30 is end-cap 35. End-cap 35 will retain aerosol generator 38 within canister 30. As shown in FIG. 1, end-cap 35 can be a hinged snap-lock construct but virtually any type of end-cap such as a threaded closure and threaded canister may be used. Any other manner of end-cap that will keep the aerosol generator in place may be used. Either end-cap 35 or distal end 32 of canister 30 may comprise a gasket (not shown) to ensure a tight seal when the aerosol generator is in place. At present the use of commercial smoke detector testing aerosols sold in pressurized cans by entities such as CRC Industries, Inc. (Warminster, Pa.) and SDi (Wall Township, N.J.) are contemplated.

Device body 25 also comprises grip 36. Grip 36 in FIG. 1 is shown as a pistol grip as such is commonly known. Any manner of grip can be used, however, so long as it permits a secure hold on device body 25 when device 10 is in use. To this end, grip 36 may include a sleeve or coating of a slip resistant material to improve the user's hold on the device. Such slip resistant materials include, without limitation, rubber, a polymer or a polymer impregnated with a particulate material. Any of the foregoing may additionally be embossed with a cross-hatched surface.

Device body 25 is coupled to trigger 40. Trigger 40 is designed so as to remotely depress activator button 44 of aerosol generator 38 in canister 30. That is, pulling back on trigger 40 causes end 48 of lever 49 to depress activator button 44. When activator button 44 is depressed, it opens a valve (not shown) to release a smoke-simulating aerosol from nozzle 45 of generator 38. The smoke-simulating aerosol is discharged from nozzle 45 into hollow chamber 47 of device body 25. Trigger 40 may be of any design that can affect the depression of activator button 44 including that shown in FIG. 1 where trigger 40 and lever 49 are shown as one-piece hinged by hinge 50 so as to permit rotation of lever 49 onto activator button 44.

The operation of a smoke detector test device of this invention is straight forward. A pressurized can of a commercial smoke-simulating substance is placed in the canister and the canister is closed to hold the can in place. The trigger is then pulled to test that the activator button is depressed and a smoke-simulating aerosol is expelled from the pressurized can. Then the barrel of the device is inserted into a space containing a smoke detector and the end-piece of the device is made to cover the smoke detector or at least the smoke sensing element of the smoke detector. The trigger is depressed and the smoke-simulating aerosol exits the nozzle and travels through the hollow chamber into the barrel and then into the end piece. If the smoke detector is in working order, it will sound the alarm. The device can then be withdrawn from the region of the smoke detector.

What is claimed:

1. A device for testing smoke detectors in remote locations, the device comprising:

a barrel having a proximal end and a distal end;

an end-piece fluidly coupled to the distal end of the barrel, the end-piece capable of fully encompassing the sensing unit of an installed smoke detector or the entire exposed surface of the smoke detector; and a device body coupled to the proximal end of the barrel, the device body comprising:

a hollow chamber fluidly coupled to the barrel and configured to receive a nozzle of a pressurized dispensing container, a handle, and a trigger coupled to the handle, the trigger including a lever, the lever disposed in the hollow chamber of the device body and positioned to contact and press an actuator button of the pressurized dispensing container to release a smoke-simulating substance from the nozzle of pressurized dispensing container to the end-piece.

2. The device of claim 1, wherein the device body further includes a canister configured to carry the pressurized dispensing container, the canister includes a canister proximal end, a canister distal end, and a cap movably coupled to the canister distal end, and wherein the canister proximal end is fluidly coupled to the hollow chamber of the device body, and the cap is configured to sealably enclose the pressurized dispensing container within the canister.

3. The device of claim 1, wherein the end-piece is cup-shaped.

4. The device of claim 1, wherein the barrel is a rigid, curved construct having a fixed length of about 12 inches to about 48 inches.

5. The device of claim 1, wherein the barrel is a flexible construct having a fixed length from about 12 inches to about 48 inches.

6. The device of claim 1, wherein the barrel is an extendable, retractable member having a retracted length of about 12 inches and an extended length of about 48 inches.

7. The device of claim 1, wherein the end-piece is removably coupled to the distal end of the barrel.

8. The device of claim 3, wherein the cup-shaped end-piece comprises a cup and a gasket disposed around a rim of the cup.

9. The device of claim 2, wherein the cap is moveably coupled to the canister by a hinge.

10. The device of claim 2, wherein a gasket is disposed between a lip of the cap and an edge of the canister distal end.

11. The device of claim 1, wherein the handle comprises a pistol grip.

12. The device of claim 1, wherein the barrel is fixedly coupled to the device body.

13. The device of claim 1, wherein the barrel is removably coupled to the device body.

14. The device of claim 2, wherein the canister is fixedly coupled to the device body.

15. The device of claim 2, wherein the canister is removably coupled to the device body.

16. A kit comprising:

the device of claim 1; and a pressurized dispensing container including a nozzle sized to be received into the hollow chamber of the device body.

17. The kit of claim 16, wherein the barrel of the device is referred to as a first barrel, and the kit further comprises a second barrel configured to be coupled to the end-piece, the second barrel having a curvature defining a degree of bending that is different from that of the first barrel.

18. The kit of claim 16, wherein end-piece is referred to as a first end-piece, and the kit further comprises a second end-piece having a size different from that of the first end-piece.

* * * * *